US005403223A

United States Patent [19]

Gaulkin et al.

[11] Patent Number: 5,403,223

[45] Date of Patent: Apr. 4, 1995

[54] SIMULATED BALLERINA AND DANCE STUDIO APPARATUS

[76] Inventors: Marianne Q. Gaulkin, 9915 SW. 114th Ct., Miami, Fla. 33176; Alice B. Quigley, 3242 Mary St. S214, Coconut Grove, Fla. 33133

[21] Appl. No.: 177,479

[22] Filed: Jan. 5, 1994

[51] Int. Cl.[6] ..... A63H 33/22; A63H 33/00; A63H 3/00

[52] U.S. Cl. ..... 446/219; 446/488; 446/73

[58] Field of Search ..... 446/219, 73, 82, 83, 446/268, 350, 332, 370, 371, 375, 381, 487, 488, 476, 478

[56] References Cited

U.S. PATENT DOCUMENTS

| | | | |
|---|---|---|---|
| 334,622 | 1/1886 | Sherman | 446/219 X |
| 604,243 | 5/1898 | Verpillier et al. . | |
| 1,583,775 | 5/1926 | Brandt | 446/487 X |
| 2,872,753 | 2/1959 | Fentan | 446/478 |
| 3,700,384 | 10/1972 | Gardel et al. | 446/330 X |
| 3,888,039 | 6/1975 | Snyder et al. . | |
| 4,030,234 | 6/1977 | Allen et al. . | |
| 4,070,789 | 1/1978 | Levenson . | |
| 4,157,633 | 6/1979 | Reiner et al. | 446/219 |
| 4,274,224 | 6/1981 | Pugh et al. | 446/375 |
| 4,361,981 | 12/1982 | Reiling et al. | 446/219 |
| 4,608,799 | 9/1986 | Hasegawa | 446/488 X |
| 4,883,443 | 11/1989 | Chase . | |
| 4,919,982 | 4/1990 | Hayes . | |

FOREIGN PATENT DOCUMENTS

| | | | |
|---|---|---|---|
| 2197800 | 6/1988 | United Kingdom | 446/370 |

*Primary Examiner*—Robert A. Hafer
*Assistant Examiner*—D. Neal Muir

[57] ABSTRACT

A new and improved simulated ballerina and dance studio apparatus includes a simulated ballerina assembly and a simulated ballet studio assembly. The simulated ballerina assembly is anatomically correct and includes a head assembly, a neck assembly which supports the head assembly, a torso assembly which supports the neck assembly, a pair of upper limb assemblies supported by the torso assembly, and a pair of lower limb assemblies supported by the torso assembly. The simulated ballet studio assembly includes a first wall assembly which includes a wall mirror attached thereto. The simulated ballet studio assembly also includes a second wall assembly and a third wall assembly connected to the first wall assembly at ends of the first wall assembly. A horizontal bar is connected between the second wall assembly and the third wall assembly. A floor assembly includes a portion which spans between the second wall assembly and the third wall assembly adjacent to the first wall assembly. Dimensions of the simulated ballerina assembly and the simulated ballet studio assembly are selected such that when the simulated ballerina assembly is standing on a lower limb assembly, an upper limb assembly and/or a lower limb assembly is capable of contacting the horizontal bar of the simulated ballet studio assembly.

7 Claims, 3 Drawing Sheets

SIMULATED BALLERINA AND DANCE STUDIO APPARATUS

BACKGROUND OF THE INVENTION

1. Field of the Invention

The present invention relates generally to dolls and miniature buildings and, more particularly, to a doll and a miniature building that simulates a real-life person and building.

2. Description of the Prior Art

Dolls and doll houses or other buildings scaled down to doll size are well known in the art. Aside from doll houses, it is well known to have miniature farms, miniature battlefields, and miniature gasoline stations, among others, to be associated with corresponding dolls. An environment that the prior art of dolls and miniature buildings does not disclose is a ballet studio. Many persons, both children and adults, spend a considerable amount of time in a ballet studio. In this respect, for a number of reasons, it would be desirable if a doll and a simulated building were provided which represented a ballerina and a ballet studio. Some reasons for the desirability of a simulated ballerina and dance studio are as follows. They would serve as a reminder to a ballet student to practice ballet exercises. They could serve as an attractive decoration in a ballet studio.

When a ballet student leaves the ballet studio, it is often difficult for the student to remember the body positions that are required. In this respect, it would be desirable if a simulated ballerina were provided that could be adjusted to depict body positions of a ballerina which may be difficult for the student to remember.

In a ballet class, a number of exercises are done in association with a horizontal bar in front of a wall mirror. The horizontal bar is used for balancing the student as the student goes through a number of exercises. In this respect, it would be deskable if a simulated ballerina and dance studio apparatus were provided which included a horizontal bar onto which the hand of the ballerina doll can be placed in order to balance the doll.

Throughout the years, a number of innovations have been developed relating to doll houses, and the following U.S. patents are representative of some of those innovations: U.S. Pat. Nos. 3,888,039; 4,030,234; 4,070,789; 4,883,443; and 4,919,982. More specifically, the above-cited patents relate to doll buildings that can be folded or disassembled. However, none of the patents disclose a simulated ballerina or a simulated ballet studio.

Many dolls are known in the prior art. Some of the prior art dolls include articulated joints. However, none of the dolls in the known prior art contain the number and quality of articulated joints that would permit a ballerina doll to be adjusted into known ballet positions. In this respect, it would be desirable if a doll were provided which contained the number and quality of articulated joints that permit the ballerina doll to be adjusted into known ballet positions.

An articulated joint that permits the ballerina doll to be adjusted into known ballet positions should be able to be easily adjusted and should retain its adjusted position.

In a simulated ballet studio there are a number of features that would be most significant in the simulation. The key features to be simulated are the horizontal bar, the wall mirror, and the dance floor.

Thus, while the foregoing body of prior art indicates it to be well known to use dolls and doll houses, the prior art described above does not teach or suggest a simulated ballerina and dance studio apparatus which has the following combination of desirable features: (1) represents a ballerina and a ballet studio; (2) can be adjusted to depict body positions of a ballerina which may be difficult for a ballet student to remember; (3) includes a horizontal bar onto which the hand of a ballerina doll can be placed in order to balance the doll; (4) contains the number and quality of articulated joints that permit the ballerina doll to be adjusted into known ballet positions; (5) includes articulated joints that permit the ballerina doll to be adjusted into known ballet positions easily and with good retention of the adjusted position; and (6) has a simulated ballet studio which includes a horizontal bar, a wall mirror, and a dance floor. The foregoing desired characteristics are provided by the unique simulated ballerina and dance studio apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved simulated ballerina and dance studio apparatus which includes a simulated ballerina assembly and a simulated ballet studio assembly. The simulated ballerina assembly is anatomically correct and includes a head assembly, a neck assembly which supports the head assembly, a torso assembly which supports the neck assembly, a pair of upper limb assemblies supported by the torso assembly, and a pair of lower limb assemblies supported by the torso assembly. The simulated ballet studio assembly includes a first wall assembly which includes a wall mirror attached thereto. The simulated ballet studio assembly also includes a second wall assembly and a third wall assembly connected to the first wall assembly at ends of the first wall assembly. A horizontal bar is connected between the second wall assembly and the third wall assembly. A floor assembly includes a portion which spans between the second wall assembly and the third wall assembly adjacent to the first wall assembly. Dimensions of the simulated ballerina assembly and the simulated ballet studio assembly are selected such that when the simulated ballerina assembly is standing on a lower limb assembly, an upper limb assembly and/or a lower limb assembly is capable of contacting the horizontal bar of the simulated ballet studio assembly.

The simulated ballerina assembly includes a head assembly which includes a head portion. A neck assembly includes a neck portion. An articulated head/neck joint is connected between the head portion and the neck portion.

A torso assembly includes a torso portion connected to the neck portion. A pair of upper limb assemblies include a pair of upper arm portions. A pair of articulated shoulder joints are connected between the torso portion and the pair of upper arm portions. The pair of upper limb assemblies also include a pair of lower arm portions. A pair of articulated elbow joints are connected between the pair of upper arm portions and the pair of lower arm portions. A pair of hand portions and a pair of articulated wrist joints are connected between the pair of lower arm portions and the pair of hand portions.

A pair of lower limb assemblies include a pair of thigh portions. A pair of articulated hip joints are connected between the torso portion and the pair of thigh portions. The pair of lower limb assemblies also include a pair of leg portions. A pair of articulated knee joints are connected between the pair of thigh portions and the pair of leg portions. The pair of lower limb assemblies also include a pair of foot portions, and a pair of articulated ankle joints are connected between the pair of leg portions and the pair of foot portions.

An outer skin is provided for covering the articulated joints. The articulated joints includes ball-and-socket joints. Sufficient friction between the respective balls and sockets permit a joint to be set and a retained in a continuum of predetermined joint positions. More specifically, the simulated ballerina assembly can be oriented in common ballet positions known as first position, second position, third position, fourth position, and fifth position. Teachers can use the simulated ballerina assembly for demonstrating proper positions. Students can use the simulated ballerina assembly for studying the appropriate positions.

The simulated ballet studio assembly may be formed from a planar blank assembly which includes a reinforcement member. A first wall assembly is connected to the reinforcement member by a first fold. The first wall assembly includes a wall mirror attached thereto. A first lateral element is connected to a first side of the first wall assembly by a second fold. A second lateral element is connected to a second side of the first wall assembly by a third fold. A first floor assembly element is connected to the first wall assembly by a fourth fold. A third lateral element is connected to a first side of the first floor assembly element by a fifth fold. A fourth lateral element is connected to a second side of the first floor assembly element by a sixth fold. A fifth lateral element is connected to the third lateral element by a seventh fold, and a sixth lateral element is connected to the fourth lateral element by an eighth fold.

A second wall assembly is formed by the first lateral element, the third lateral element, and the fifth lateral element when the first wall assembly is folded along the fourth fold toward the first floor assembly element, the first lateral element is folded along the second fold toward the first wall assembly, the third lateral element is folded along the fifth fold toward the first floor assembly element, and the fifth lateral element is folded along the seventh fold toward the third lateral element.

A third wall assembly is formed by the second lateral element, the fourth lateral element, and the sixth lateral element when the first wall assembly is folded along the fourth fold toward the first floor assembly element, the second lateral element is folded along the third fold toward the first wall assembly, the fourth lateral element is folded along the sixth fold toward the first floor assembly element, and the sixth lateral element is folded along the eighth fold toward the fourth lateral element.

The first lateral element, the second lateral element, the third lateral element, and the fourth lateral element each includes a respective aperture. The apertures are positioned on the respective lateral elements such that when the respective lateral elements and the respective first wall assembly are folded, the respective apertures are placed in registration for receiving a horizontal bar.

A second floor assembly element is connected to the first floor assembly clement by a ninth fold, and a third floor assembly element is connected to the second floor assembly element by a tenth fold.

A foot portion of a lower limb assembly includes a well portion located on a bottom side of the foot portion. A base assembly is provided which includes a base element and a protuberance projecting upward from the base element which is capable of connecting with the well portion of the foot portion, whereby the base assembly is capable of supporting the simulated ballerina assembly in a vertical orientation.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved simulated ballerina and dance studio apparatus which has all of the advantages of the prior art and none of the disadvantages.

It is another object of the present invention to provide a new and improved simulated ballerina and dance studio apparatus which may be easily and efficiently manufactured and marketed.

It is a further object of the present invention to provide a new and improved simulated ballerina and dance studio apparatus which is of durable and reliable construction.

An even further object of the present invention is to provide a new and improved simulated ballerina and dance studio apparatus which is susceptible of a low cost of manufacture with regard to both materials and labor, and which accordingly is then susceptible of low prices of sale to the consuming public, thereby making such simulated ballerina and dance studio apparatus available to the buying public.

Still yet a further object of the present invention is to provide a new and improved simulated ballerina and dance studio apparatus which represents a ballerina and a ballet studio.

Still another object of the present invention is to provide a new and improved simulated ballerina and dance studio apparatus that can be adjusted to depict body positions of a ballerina which may be difficult for a ballet student to remember.

Yet another object of the present invention is to provide a new and improved simulated ballerina and dance studio apparatus which includes a horizontal bar onto which the hand of a ballerina doll can be placed in order to balance the doll.

Even another object of the present invention is to provide a new and improved simulated ballerina and dance studio apparatus that contains the number and quality of articulated joints that permit the ballerina doll to be adjusted into known ballet positions.

Still a further object of the present invention is to provide a new and improved simulated ballerina and dance studio apparatus which includes articulated joints that permit the ballerina doll to be adjusted into known ballet positions easily and with good retention of the adjusted position.

Yet another object of the present invention is to provide a new and improved simulated ballerina and dance studio apparatus that has a simulated ballet studio which includes a horizontal bar, a wall mirror, and a dance floor.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved simulated ballerina and dance studio apparatus embodying the principles and concepts of the present invention will be described.

Figure 1:
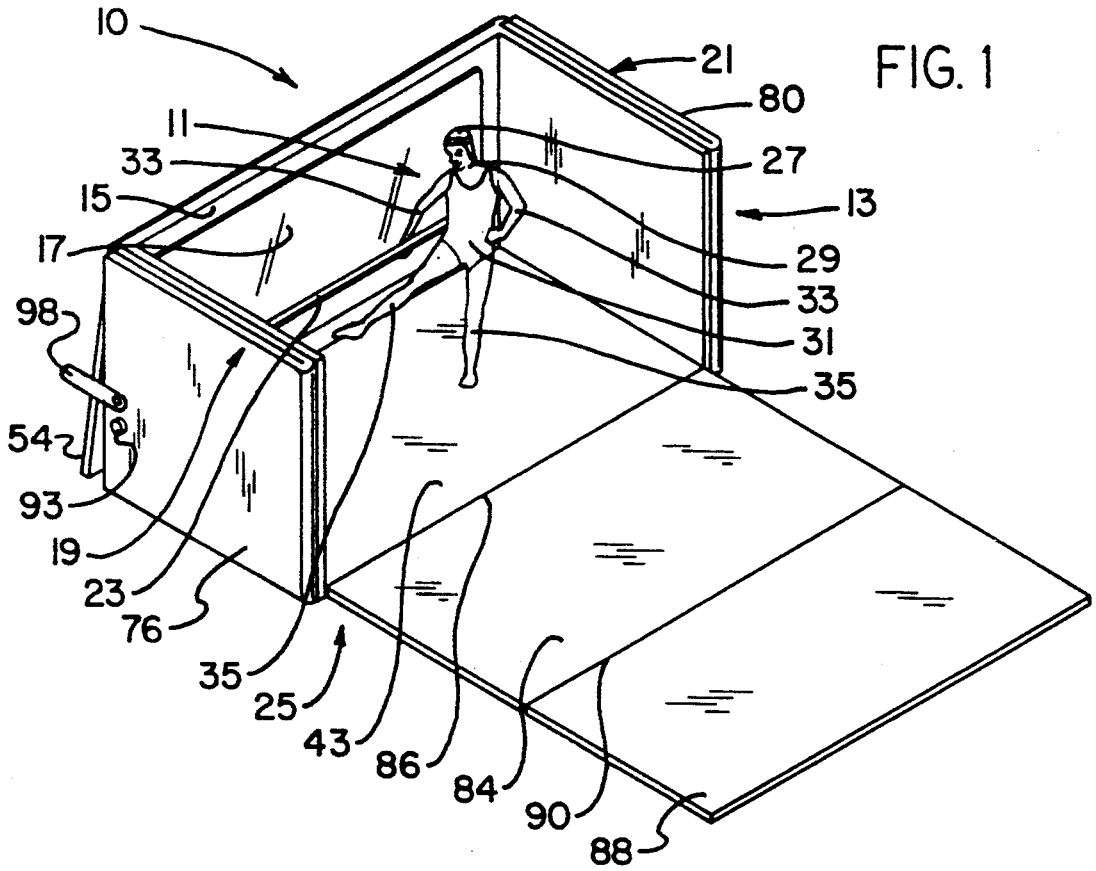
FIG. 1 is a perspective view showing a preferred embodiment of the simulated ballerina and dance studio apparatus of the invention.

As shown in FIG. 1, a new and improved simulated ballerina and dance studio apparatus 10 includes a simulated ballerina assembly 11 and a simulated ballet studio assembly 13. The simulated ballerina assembly 11 is anatomically correct and includes a head assembly 27, a neck assembly 29 which supports the head assembly 27, a torso assembly 31 which supports the neck assembly 29, a pair of upper limb assemblies 33 supported by the torso assembly 31, and a pair of lower limb assemblies 35 supported by the torso assembly 31. The simulated ballet studio assembly 13 includes a first wall assembly 15 which includes a wall mirror 17 attached thereto. The simulated ballet studio assembly 13 also includes a second wall assembly 19 and a third wall assembly 21 connected to the first wall assembly 15 at ends of the first wall assembly 15. A horizontal bar 23 is connected between the second wall assembly 19 and the third wall assembly 21. A floor assembly 25 includes a portion which spans between the second wall assembly 19 and the third wall assembly 21 adjacent to the first wall assembly 15. Dimensions of the simulated ballerina assembly 11 and the simulated ballet studio assembly 13 are selected such that when the simulated ballerina assembly 11 is standing on a lower limb assembly 35, an upper limb assembly 33 and/or lower limb assembly 35 is capable of contacting the horizontal bar 23 of the simulated ballet studio assembly 13.

Figure 2:
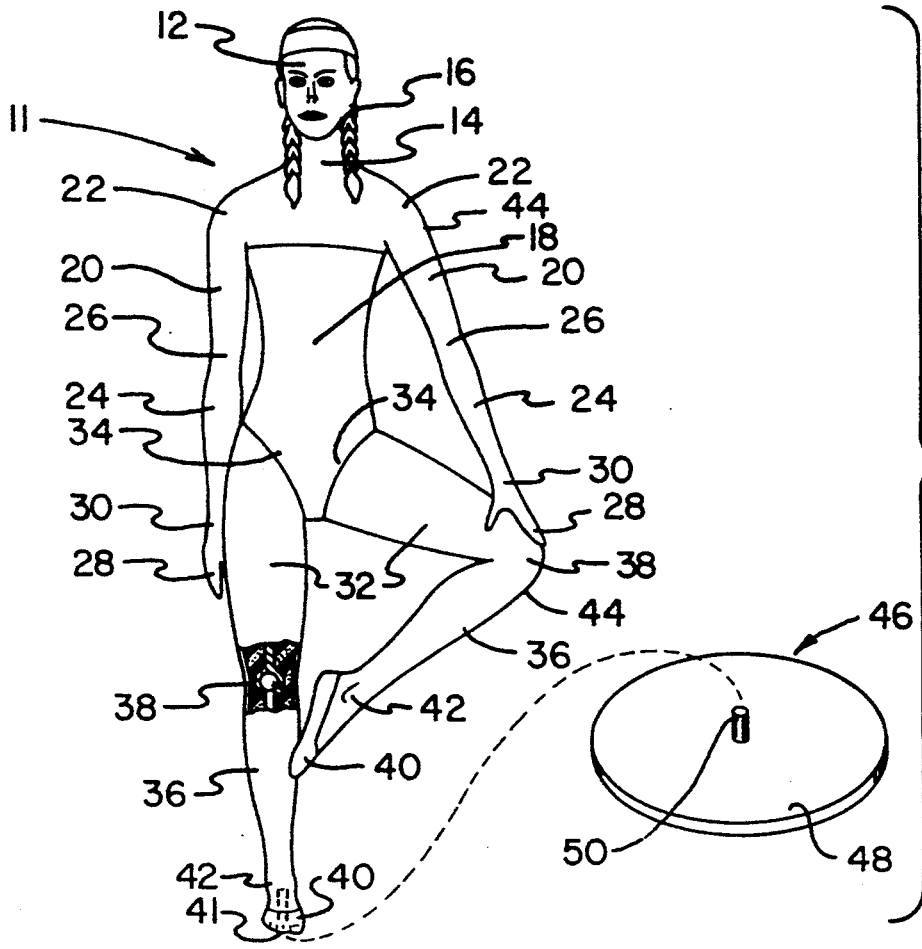
FIG. 2 is an enlarged, partially exploded view of a simulated ballerina assembly used in the embodiment of the invention shown in FIG. 1.

As shown in FIG. 2, the simulated ballerina assembly 11 includes a head assembly 27 which includes a head portion 12. A neck assembly 29 includes a neck portion 14. An articulated head/neck joint 16 is connected between the head portion 12 and the neck portion 14.

A torso assembly 31 includes a torso portion 18 connected to the neck portion 14. A pair of upper limb assemblies 33 include a pair of upper arm portions 20. A pair of articulated shoulder joints 22 are connected between the torso portion 18 and the pair of upper arm portions 20. The pair of upper limb assemblies 33 also include a pair of lower arm portions 24. A pair of articulated elbow joints 26 are connected between the pair of upper arm portions 20 and the pair of lower arm portions 24. A pair of hand portions 28 and a pair of articulated wrist joints 30 are connected between the pair of lower arm portions 24 and the pair of hand portions 28.

A pair of lower limb assemblies 35 include a pair of thigh portions 32. A pair of articulated hip joints 34 are connected between the torso portion 18 and the pair of thigh portions 32. The pair of lower limb assemblies 35 also include a pair of leg portions 36. A pair of articulated knee joints 38 are connected between the pair of thigh portions 32 and the pair of leg portions 36. The pair of lower limb assemblies 35 also include a pair of foot portions 40, and a pair of articulated ankle joints 42 are connected between the pair of leg portions 36 and the pair of foot portions 40.

An outer skin 44 is provided for covering the articulated joints. The articulated joints includes ball-and-socket joints. Sufficient friction between the respective balls and sockets permit a joint to be set and a retained in a continuum of predetermined joint positions. More specifically, the simulated ballerina assembly 11 can be oriented in common ballet positions known as first position, second position, third position, fourth position, and fifth position. Teachers can use the simulated ballerina assembly 11 for demonstrating proper positions. Students can use the simulated ballerina assembly 11 for studying the appropriate positions.

Figure 3:
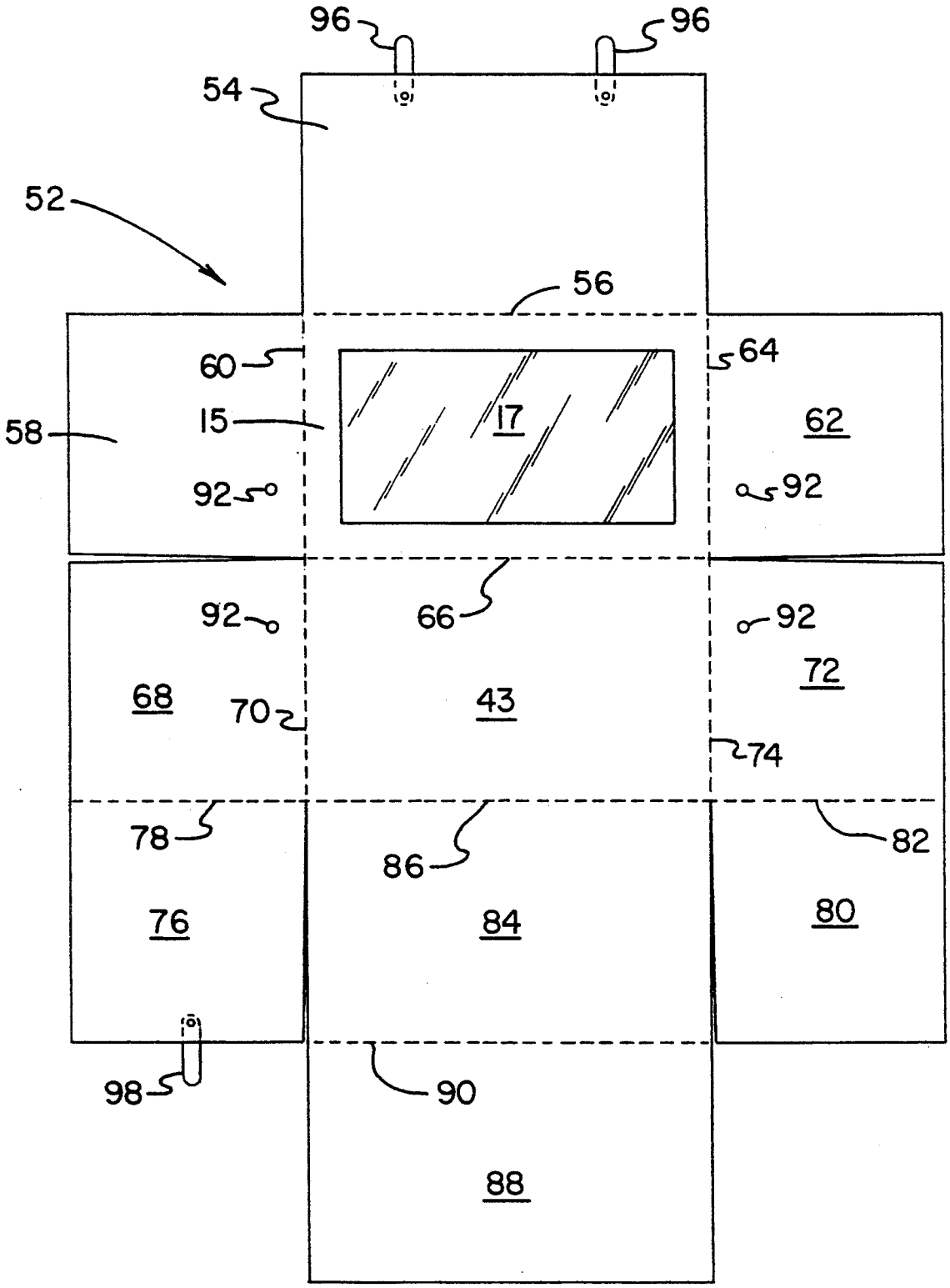
FIG. 3 is a top view of a planar blank for the embodiment of the simulated ballet studio assembly of the invention shown in FIG. 1.

As shown in FIG. 3, the simulated ballet studio assembly 13 is formed from a planar blank assembly 52 which includes a reinforcement member 54. A first wall assembly 15 is connected to the reinforcement member 54 by a first fold 56. The first wall assembly 15 includes a wall mirror 17 attached thereto. A first lateral element 58 is connected to a first side of the first wall assembly 15 by a second fold 60. A second lateral element 62 is connected to a second side of the first wall assembly 15 by a third fold 64. A first floor assembly element 43 is connected to the first wall assembly 15 by a fourth fold 66. A third lateral element 68 is connected to a first side of the first floor assembly element 43 by a fifth fold 70. A fourth lateral element 72 is connected to a second side of the first floor assembly element 43 by a sixth fold 74. A fifth lateral element 76 is connected to the third lateral element 68 by a seventh fold 78, and a sixth lateral element 80 is connected to the fourth lateral element 72 by an eighth fold 82.

A second wall assembly 19 is formed by the first lateral element 58, the third lateral element 68, and the fifth lateral element 76 when the first wall assembly 15 is folded along the fourth fold 66 toward the first floor assembly element 43, the first lateral element 58 is folded along the second fold 60 toward the first wall assembly 15, the third lateral element 68 is folded along the fifth fold 70 toward the first floor assembly element 43, and the fifth lateral element 76 is folded along the seventh fold 78 toward the third lateral element 68.

A third wall assembly 21 is formed by the second lateral element 62, the fourth lateral element 72, and the sixth lateral element 80 when the first wall assembly 15 is folded along the fourth fold 66 toward the first floor assembly element 43, the second lateral element 62 is folded along the third fold 64 toward the first wall assembly 15, the fourth lateral element 72 is folded along the sixth fold 74 toward the first floor assembly element 43, and the sixth lateral element 80 is folded along the eighth fold 82 toward the fourth lateral element 72.

The first lateral element 58, the second lateral element 62, the third lateral element 68, and the fourth lateral element 72 each includes a respective aperture 92. The apertures 92 are positioned on the respective lateral elements such that when the respective lateral elements and the respective first wall assembly 15 are folded, the respective apertures 92 are placed in registration for receiving a horizontal bar 23.

A second floor assembly element 84 is connected to the first floor assembly element 43 by a ninth fold 86, and a third floor assembly element 88 is connected to the second floor assembly element 84 by a tenth fold 90. The first floor assembly element 43, the second floor assembly element 84, and the third floor assembly element 88 can include an upper surface that simulates wood grain.

As shown in FIG. 2, a foot portion 40 of a lower limb assembly 35 includes a well portion 41 located on a bottom side of the foot portion 40. A base assembly 46 is provided which includes a base element 48 and a protuberance 50 projecting upward from the base element 48 which is capable of connecting with the well portion 41 of the foot portion 40, whereby the base assembly 46 is capable of supporting the simulated ballerina assembly 11 in a vertical orientation.

Figure 4:
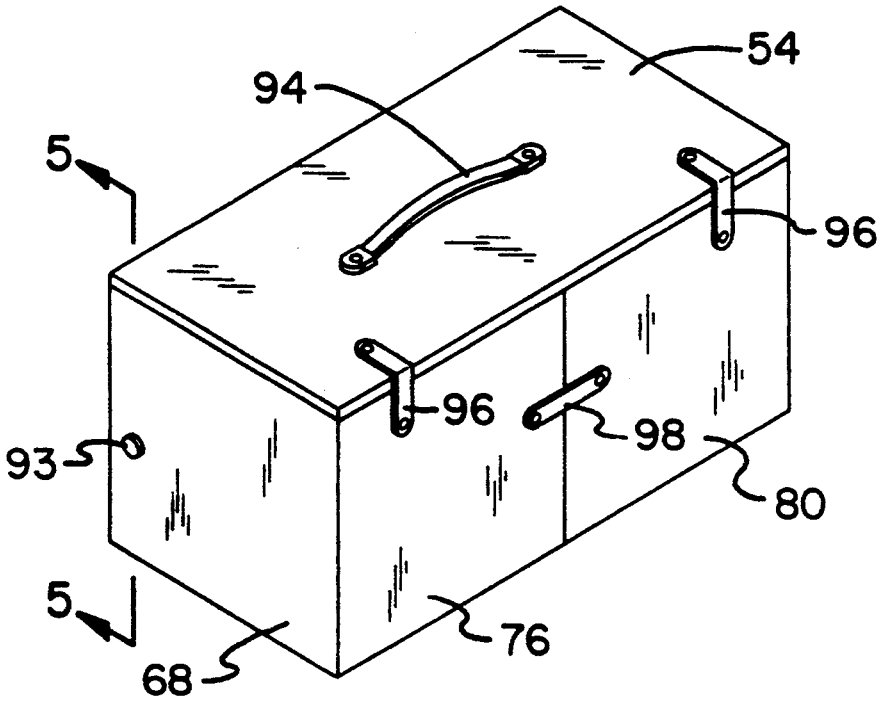
FIG. 4 is a perspective view of the embodiment of the invention shown in FIG. 1 in a folded-up and secured condition suitable for carrying.

As shown in FIG. 4, the embodiment of the simulated ballerina and dance studio apparatus 10 of the invention can be folded up into a convenient carrying case. To provide the carrying case, a handle assembly 94 is attached to a bottom side of the reinforcement member 54 shown in FIG. 3. In addition, first connector assemblies 96 are connected between the reinforcement member 54 and the respective fifth lateral element 76 and the sixth lateral element 80 when (a) the second floor assembly element 84 is folded up toward the first floor assembly element 43 and is oriented perpendicular to the first floor assembly element 43 and (b) when the third floor assembly element 88 is folded up toward the second floor assembly element 84 and is oriented perpendicular to the second floor assembly element 84. In this position, the third floor assembly element 88 is positioned over the first floor assembly element 43. In addition, a second connector assembly 98 is connected between the fifth lateral element 76 and the sixth lateral element 80 when the fifth lateral element 76 is folded back over the second floor assembly element 84, and the sixth lateral element 80 is folded back over the second floor assembly element 84.

Figure 5:
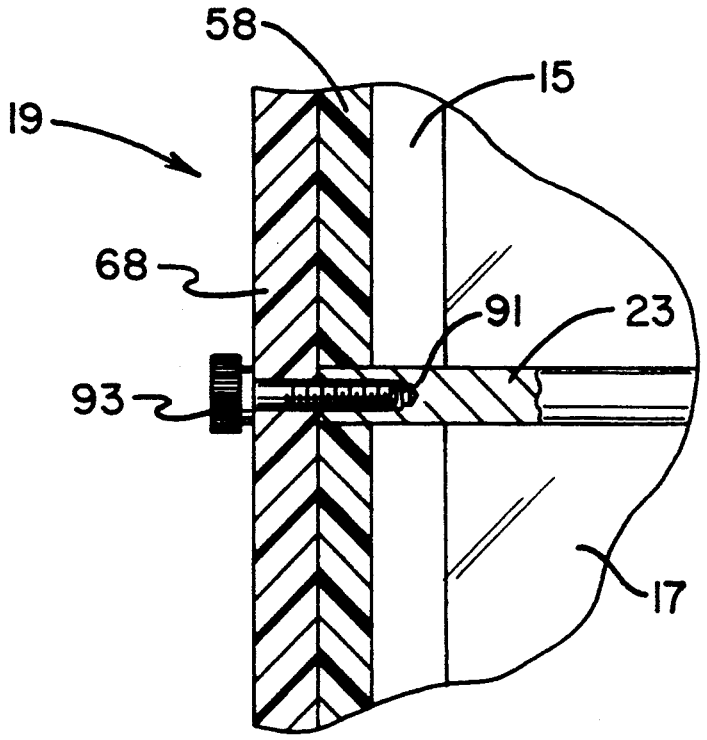
FIG. 5 is a partial cross-sectional view of the embodiment of the invention shown in FIG. 4 taken along line 5—5 of FIG. 4.

As shown in FIG. 5, the horizontal bar 23 has a threaded well 91, and such a threaded well 91 is at each end of the horizontal bar 23. A complementary threaded bolt 93 is placed through the apertures 92 which are placed in registration when the respective lateral elements are folded into position. In this way, one end of the horizontal bar 23 is secured to the second wall assembly 19, and the other end of the horizontal bar 23 is secured to the third wall assembly 21.

The components of the simulated ballerina and dance studio apparatus of the invention can be made from inexpensive and durable plastic and rubber materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved simulated ballerina and dance studio apparatus that is low in cost, relatively simple in design and operation, and which may advantageously be used to represent a ballerina and a ballet studio. With the invention, a simulated ballerina and dance studio apparatus is provided which can be adjusted to depict body positions of a ballerina which may be difficult for a ballet student to remember. With the invention, a simulated ballerina and dance studio apparatus is provided which includes a horizontal bar onto which the hand of a ballerina doll can be placed in order to balance the doll. With the invention, a simulated ballerina and dance studio apparatus is provided which contains the number and quality of articulated joints that permit the ballerina doll to be adjusted into known ballet positions. With the invention, a simulated ballerina and dance studio apparatus is provided which includes articulated joints that permit the ballerina doll to be adjusted into known ballet positions easily and with good retention of the adjusted position. With the invention, a simulated ballerina and dance studio apparatus is provided which has a simulated ballet studio which includes a horizontal bar, a wall mirror, and a dance floor.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved simulated ballerina and dance studio apparatus, comprising:

a simulated ballerina assembly which includes a head assembly, a neck assembly which supports said head assembly, a torso assembly which supports said neck assembly, a pair of upper limb assemblies supported by said torso assembly, and a pair of lower limb assemblies supported by said torso assembly, and a selectively foldable and unfoldable simulated ballet studio assembly which includes a first wall assembly which includes a wall mirror attached thereto and which includes a second wall assembly and a third wall assembly connected to said first wall assembly at ends of said first wall assembly, which includes a horizontal bar connected between said second wall assembly and said third wall assembly, said horizontal bar in front of and displaced from said mirror and above said floor at a height approximately that defined by said lower limb assemblies of said simulated ballerina, and which includes a floor assembly which spans between said second wall assembly and said third wall assembly adjacent to said first wall assembly, wherein dimensions of said simulated ballerina assembly and said simulated ballet studio assembly with a positioning of said horizontal bar are selected such that when said simulated ballerina assembly is standing on a lower limb assembly, a portion of an upper limb assembly and a portion of a lower limb assembly is adapted for elevation and placement to contact said horizontal bar of said simulated ballet studio assembly.

2. The apparatus described in claim 1 wherein said simulated ballerina assembly includes:

a head assembly which includes a head portion, a neck assembly which a neck portion, an articulated head/neck joint connected between said head portion and said neck portion, a torso assembly which includes a torso portion connected to said neck portion, a pair of upper limb assemblies which include a pair of upper arm portions, a pair of articulated shoulder joints connected between said torso portion and said pair of upper arm portions, a pair of lower arm portions, a pair of articulated elbow joints connected between said pair of upper arm portions and said pair of lower arm portions, a pair of hand portions, and a pair of articulated wrist joints connected between said pair of lower arm portions and said pair of hand portions, and a pair of lower limb assemblies which include a pair of thigh portions, a pair of articulated hip joints connected between said torso portion and said pair of thigh portions, a pair of leg portions, a pair of articulated knee joints connected between said pair of thigh portions and said pair of leg portions, a pair of foot portions, and a pair of articulated ankle joints connected between said pair of leg portions and said pair of foot portions.

3. The apparatus described in claim 2, further including an outer skin for covering said articulated joints.

4. The apparatus described in claim 2 wherein said articulated joints include ball-and-socket joints.

5. A new and improved simulated ballerina and dance studio apparatus, comprising:

a simulated ballerina assembly which includes a head assembly, a neck assembly which supports said head assembly, a torso assembly which supports said neck assembly, a pair of upper limb assemblies supported by said torso assembly, and a pair of lower limb assemblies supported by said torso assembly, and a simulated ballet studio assembly which includes a first wall assembly which includes a wall mirror attached thereto and which includes a second wall assembly and a third wall assembly connected to said first wall assembly at ends of said first wall assembly, which includes a horizontal bar connected between said second wall assembly and said third wall assembly, and which includes a floor assembly which spans between said second wall assembly and said third wall assembly adjacent to said first wall assembly, wherein dimensions of said simulated ballerina assembly and said simulated ballet studio assembly are selected such that when said simulated ballerina assembly is standing on a lower limb assembly, a portion of an upper limb assembly and/or a portion of a lower limb assembly is capable of contacting said horizontal bar of said simulated ballet studio assembly, wherein said simulated ballet studio assembly is formed from a planar blank assembly which includes:

a reinforcement member, said first wall assembly connected to said reinforcement member by a first fold, said first wall assembly including said wall mirror attached thereto, a first lateral element connected to a first side of said first wall assembly by a second fold, a second lateral element connected to a second side of said first wall assembly by a third fold, a first floor assembly element connected to said first wall assembly by a fourth fold, a third lateral element connected to a first side of said first floor assembly element by a fifth fold, a fourth lateral element connected to a second side of said first floor assembly element by a sixth fold, a fifth lateral element connected to said third lateral element by a seventh fold, and a sixth lateral element connected to said fourth lateral element by an eighth fold, wherein said second wall assembly is formed by said first lateral element, said third lateral element, and said fifth lateral element when said first wall assembly is folded along said fourth fold toward said first floor assembly element, said first lateral element is folded along said second fold toward said first wall assembly, said third lateral element is folded along said fifth fold toward said first floor assembly element, and said fifth lateral element is folded along said seventh fold toward said third lateral element, and wherein said third wall assembly is formed by said second lateral element, said fourth lateral element, and said sixth lateral element when said first wall assembly is folded along said fourth fold toward said first floor assembly element, said second lateral element is folded along said third fold toward said first wall assembly, said fourth lateral element is folded along said sixth fold toward said first floor assembly element, and said sixth lateral element is folded along said eighth fold toward said fourth lateral element.

6. The apparatus described in claim 5 wherein said first lateral element, said second lateral element, said third lateral element, and said fourth lateral element each include a respective aperture, said apertures positioned on said respective lateral elements such that when said respective lateral elements and said respective first wall assembly are folded, said respective apertures are placed in registration for receiving said horizontal bar.

7. The apparatus described in claim 6, further including:

a second floor assembly element connected to said first floor assembly element by a ninth fold, and a third floor assembly element connected to said second floor assembly element by a tenth fold.

* * * * *